US010514206B2

(12) United States Patent
Deivasigamani et al.

(10) Patent No.: US 10,514,206 B2
(45) Date of Patent: Dec. 24, 2019

(54) MULTI-COIL HEAT EXCHANGER

(71) Applicants: Sridhar Deivasigamani, Peoria, IL (US); Sivaprasad Akasam, Dunlap, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 182 days.

(21) Appl. No.: 15/903,544

(22) Filed: Feb. 23, 2018

(65) Prior Publication Data

US 2018/0245855 A1 Aug. 30, 2018

Related U.S. Application Data

(60) Provisional application No. 62/463,584, filed on Feb. 24, 2017.

(51) Int. Cl.

| | |
|---|---|
| ***F25B 29/00*** | (2006.01) |
| ***F28D 7/02*** | (2006.01) |
| ***F28D 1/047*** | (2006.01) |
| ***F28F 9/24*** | (2006.01) |
| ***F28F 13/06*** | (2006.01) |
| ***F28F 13/16*** | (2006.01) |
| ***F24H 1/52*** | (2006.01) |
| ***F28F 27/02*** | (2006.01) |
| ***F24H 1/43*** | (2006.01) |
| ***F28D 21/00*** | (2006.01) |
| ***F28F 1/12*** | (2006.01) |
| ***F24D 3/08*** | (2006.01) |

(52) U.S. Cl.

CPC ..... *F28D 7/022* (2013.01); *F24D 3/087* (2013.01); *F24H 1/43* (2013.01); *F24H 1/52* (2013.01); *F28D 1/0472* (2013.01); *F28D 21/0007* (2013.01); *F28F 1/12* (2013.01); *F28F 9/24* (2013.01); *F28F 13/06* (2013.01); *F28F 13/16* (2013.01); *F28F 27/02* (2013.01)

(58) Field of Classification Search

CPC .... F28D 7/022; F28D 1/0472; F28D 21/0007; F24D 3/087; F24H 1/43; F24H 1/52; F28F 1/12; F28F 9/24; F28F 13/06; F28F 13/16; F28F 27/02

USPC ..... 122/13.01

See application file for complete search history.

(56) References Cited

U.S. PATENT DOCUMENTS

| | | | | |
|---|---|---|---|---|
| 1,799,081 A * | 3/1931 | Blomqvist | F25B 39/04 | 165/164 |
| 3,896,992 A * | 7/1975 | Borovina | F24D 3/08 | 237/19 |
| 4,158,438 A * | 6/1979 | Hapgood | F23D 14/58 | 122/33 |
| 4,401,261 A * | 8/1983 | Brown | F28D 21/0007 | 122/20 B |
| 4,426,037 A * | 1/1984 | Bernstein | F24H 1/287 | 122/18.4 |

(Continued)

*Primary Examiner* — Claire E Rojohn, III

(74) *Attorney, Agent, or Firm* — Tracy Jong Law Firm; Tracy P. Jong; Cheng Ning Jong

(57) ABSTRACT

A heat exchanger including more than one fluid conductor, each of the fluid conductors is configured to receive a distinct flow of fluid and heat from only one heat source, wherein the coils are configured to be interleaved to form a structure of a single-sized lumen in which the heat source is disposed.

9 Claims, 8 Drawing Sheets

(56) References Cited

U.S. PATENT DOCUMENTS 5,806,585 A * 9/1998 Yoshida ..... F25B 39/00 165/171
7,000,684 B2 * 2/2006 Kenny ..... F04B 17/00 165/104.21
2005/0133202 A1 * 6/2005 Jorgensen ..... F28D 7/024 165/103
2006/0005955 A1 * 1/2006 Orr ..... F28D 7/024 165/108
2006/0213223 A1 * 9/2006 Wilding ..... F25J 1/0262 62/613
2007/0143914 A1 * 6/2007 Shirai ..... E03D 9/08 4/420.2
2009/0151574 A1 * 6/2009 Nijboer ..... A47J 31/40 99/282
2010/0101767 A1 * 4/2010 Furui ..... F24D 3/087 165/163
2010/0195991 A1 * 8/2010 Deivasigamani ..... F24H 1/202 392/308
2011/0155366 A1 * 6/2011 Brunn ..... F28D 7/024 165/287
2011/0308259 A1 * 12/2011 Wray ..... F16L 55/103 62/3.3
2012/0266592 A1 * 10/2012 Foy ..... F02B 29/0462 60/599
2015/0096505 A1 * 4/2015 Deivasigamani ... F24D 17/0026 122/14.2
2015/0204550 A1 * 7/2015 Deivasigamani ... F24D 19/1069 237/2 A
2016/0169071 A1 * 6/2016 Deivasigamani ..... F01N 3/043 60/39.5
2016/0338231 A1 * 11/2016 Prado ..... H05K 7/20927
2018/0094832 A1 * 4/2018 Kiely ..... F24H 1/205
2018/0187980 A1 * 7/2018 Gil ..... F28D 7/022
2018/0245855 A1 * 8/2018 Deivasigamani ..... F28D 7/022

* cited by examiner

MULTI-COIL HEAT EXCHANGER

PRIORITY CLAIM AND RELATED APPLICATIONS

This non-provisional application claims the benefit of priority from provisional application U.S. Ser. No. 62/463,584 filed Feb. 24, 2017. Said application is incorporated by reference in its entirety.

BACKGROUND OF THE INVENTION

1. The Field of the Invention

The present invention relates to a multi-coil heat exchanger. More specifically, the present invention is directed to a heat exchanger having multiple coils that services either one heat transfer loop or multiple heat transfer loops.

2. Background Art

In a coiled heat exchanger, a coil is disposed within the heat exchanger and configured to receive a fluid and output the fluid in a different thermal state. In a heater, the heat exchanger is adapted to receive heat from a burner while the fluid flows through the coil. The fluid flow within the coil can range from a trickle flow, e.g., when a faucet is barely opened, to a large flow, e.g., when more than one faucet is fully open. With a single coil, the flow through the coil for typical usage routinely falls within the laminar flow regime which is ineffective in heat transfer. Flow regimes may be altered by increasing or decreasing the coil diameter. A larger diameter coil causes reduced losses in its flow due to the coil. However, a larger diameter flow may not cause increased heat transfer as it may fall more frequently within the laminar flow regime and the coil diameter may be impractically large in a compact heat exchanger and impractical to be manufactured due to same-sized turns or loops that need to be accommodated within the same space but with a larger diameter coil and decreased coil lumen. A smaller diameter coil causes increased flow resistance although the flow may also fall more frequently within the turbulent flow regime which is more beneficial for heat transfer. Therefore, by maintaining the number of coils to one, no net benefit may be realized by altering the coil diameter.

There exists a need for a heat exchanger having a net increase in benefits in increased heat transfer rate with little or no negative effects due to the configuration that causes an increase in the heat transfer rate and/or a decrease in pressure drop.

SUMMARY OF THE INVENTION

In accordance with the present invention, there is provided a fluid heating system for meeting both a demand for domestic hot water and a demand for space heating, the fluid heating system including:

(a) a first flow loop including an inlet, an outlet, a first conductor disposed between the inlet and the outlet of the first flow loop and a first pump disposed between the inlet and the outlet of the first flow loop;

(b) a second flow loop including an inlet, an outlet, a second conductor disposed between the inlet and the outlet of the second flow loop and a second pump disposed between the inlet and the outlet of the second flow loop;

(c) a heat source configured for transferring heat to a first flow urged by the first pump within the first flow loop at the first conductor to increase the temperature of the first flow and a second flow urged by the second pump within the second flow loop at the second conductor to increase the temperature of the second flow;

(d) a first internal bypass line including a first valve, the first internal bypass line connecting a first portion of the first flow loop and a second portion of the first flow loop, the first internal bypass line is disposed within the fluid heating system, wherein the first internal bypass line provides a path for bypassing the inlet and the outlet of the first flow loop when the demand for domestic hot water does not exist and the first valve prevents a bypass of a flow from the inlet to the outlet of the first flow loop;

(e) a second internal bypass line includes a three-way valve, the second internal bypass line connecting a first portion of the second flow loop, a second portion of the second flow loop, the second internal bypass line is disposed within the fluid heating system and the three-way valve is disposed at the second portion of the second flow loop, the three-way valve configured to direct the second flow through the second internal bypass line, bypassing the inlet and the outlet of the second flow loop when the demand for space heating does not exist and the second internal bypass line provides a path for the second flow when the demand for space heating does exist; and (f) a heat exchanger thermally coupling the first flow loop and the second flow loop, the heat exchanger is configured to cause heat transfer between the first flow of the first flow loop and the second flow of the second flow loop;

wherein the first flow loop, the second flow loop, the heat source and the heat exchanger cooperate to produce the first flow at a first temperature at the outlet of the first loop and the second flow at a second temperature at the outlet of the second loop.

In one embodiment, at least one of first and second conductor is a coil. In one embodiment, the heat source is a radial-fired burner. In one embodiment, the heat exchanger is a plate-type heat exchanger. In one embodiment, the heat exchanger is configured to receive a flow of fluid with a flowrate ranging from about 0.5 Gallons Per Minute (GPM) to about 30 GPM and each fluid conductor includes a nominal diameter ranging from about 0.5 inch to about 2 inch.

In one embodiment, the present fluid heating system further includes a mixing line having a valve, the mixing line connecting a third portion of the first flow loop and a fourth portion of the first flow loop, the valve of the mixing line is configured to selectively open to allow an unheated portion of the first flow to be mixed with a heated portion of the first flow to temper the temperature of the first flow at the outlet of the first flow loop.

In one embodiment, each fluid conductor is a coil. In one embodiment, the coils are configured to be interleaved.

In one embodiment, the heat source is a cylindrical or radial-fired burner.

An object of the present invention is to provide a heat exchanger capable of increased heat transfer efficiency.

Another object of the present invention is to provide a heat exchanger capable of heat transfer with more than one fluid flow.

Another object of the present invention is to provide a heat exchanger having smaller-diameter fluid conductors such that the overall coil lumen is minimized or a pump that is smaller and capable of delivering a head that is lower.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
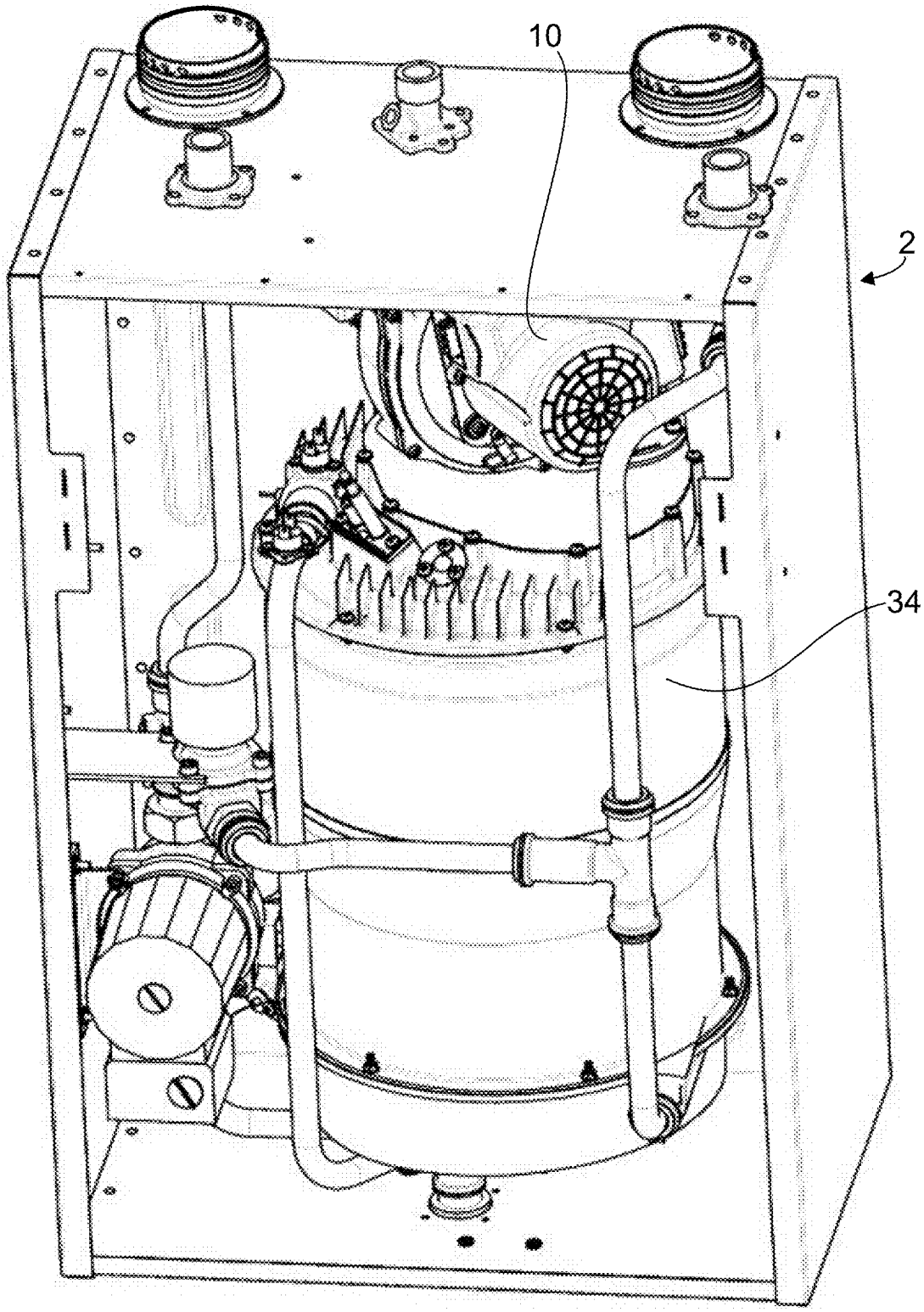
FIG. 1 is a top front perspective view of a fluid heating system including a heat exchanger system.

2—heat exchanger system
4—first fluid conductor of coil-tube heat exchanger
6—second fluid conductor of coil-tube heat exchanger
8—burner
10—blower
12—inlet manifold
14—outlet manifold
16—first inlet flow of space heating loop
18—second inlet flow of domestic hot water loop
20—flow path within manifold
22—plug
24—plate type heat exchanger
26—pump
28—pump
30—check valve
32—fin
34—housing
36—fuel-air mixture flow
38—flue flow
40—plate
42—internal bypass line
44—mixing line
46—first outlet flow of space heating loop
48—second outlet flow of domestic hot water loop
50—three-way valve
52—internal bypass line
54—valve

PARTICULAR ADVANTAGES OF THE INVENTION

In one embodiment of the present heat exchanger, a flow that is otherwise carried through a single coil of a diameter is now carried through two coils of the same size as the single coil. As the length is now only half of the single coil, this significantly lowers the pressure drop in the heat exchanger and therefore lowering the requirement of a pump capable of providing sufficient head to service a heating demand. A lower capacity pump can be therefore be used with the present heat exchanger as a result of the lower pressure drop. As an increased range of flowrates where the flows are considered turbulent is allowed through the present fluid conductors due to the lower pressure drop, the overall heat transfer rate to or from the fluids within the fluid conductors is increased. The pressure drop experienced across the coils would be about ¼ of the pressure drop that would have been experienced with only one coil and the flow in each fluid conductor is maintained at the turbulent flow regime for most demands. With a lower pressure drop in a fluid system, the requirement for a fluid mover (pump) is also lowered. Therefore, a pump that can provide a lower head can be used. This often translates to a smaller or more compact or often inexpensive pump. If necessary, the size of the present multi-coil fluid conductors may also be minimized to achieve equivalent heating results as those found in single conductors.

In one embodiment, as only one burner is required in the present heat exchanger to provide both domestic hot water and space heating, maintenance and procurement of discrete domestic hot water and space heating systems are not required. Instead, a unified and compact system capable of providing both domestic hot water and space heating is made available. Further, in one embodiment, as the present heat exchanger includes two fluid conductors, two distinct fluids can be used for as heat transfer media.

DETAILED DESCRIPTION OF A PREFERRED EMBODIMENT

The term "about" is used herein to mean approximately, roughly, around, or in the region of. When the term "about"

is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 2:
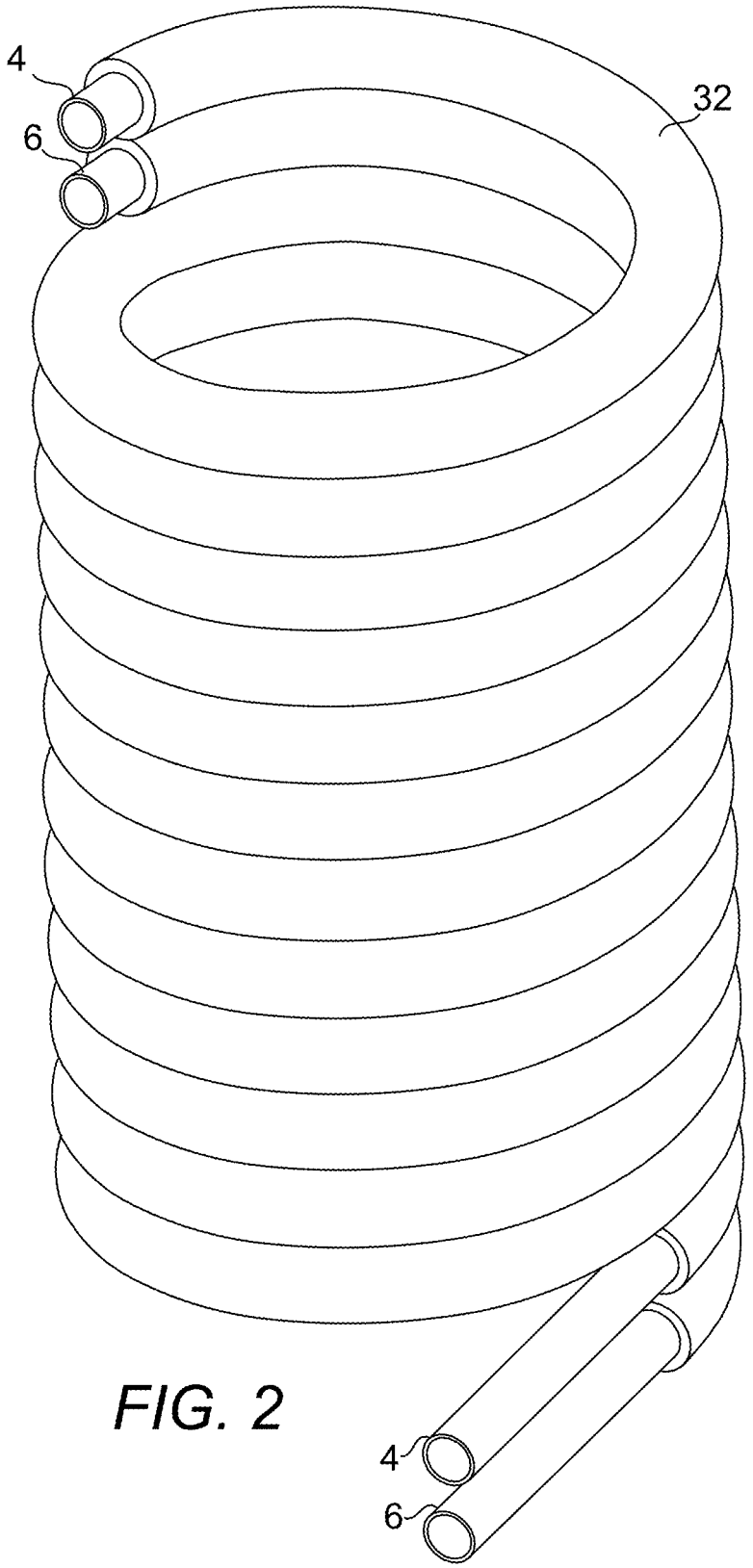
FIG. 2 is a top side view of the fluid conductors of a heat exchanger.
Figure 3:
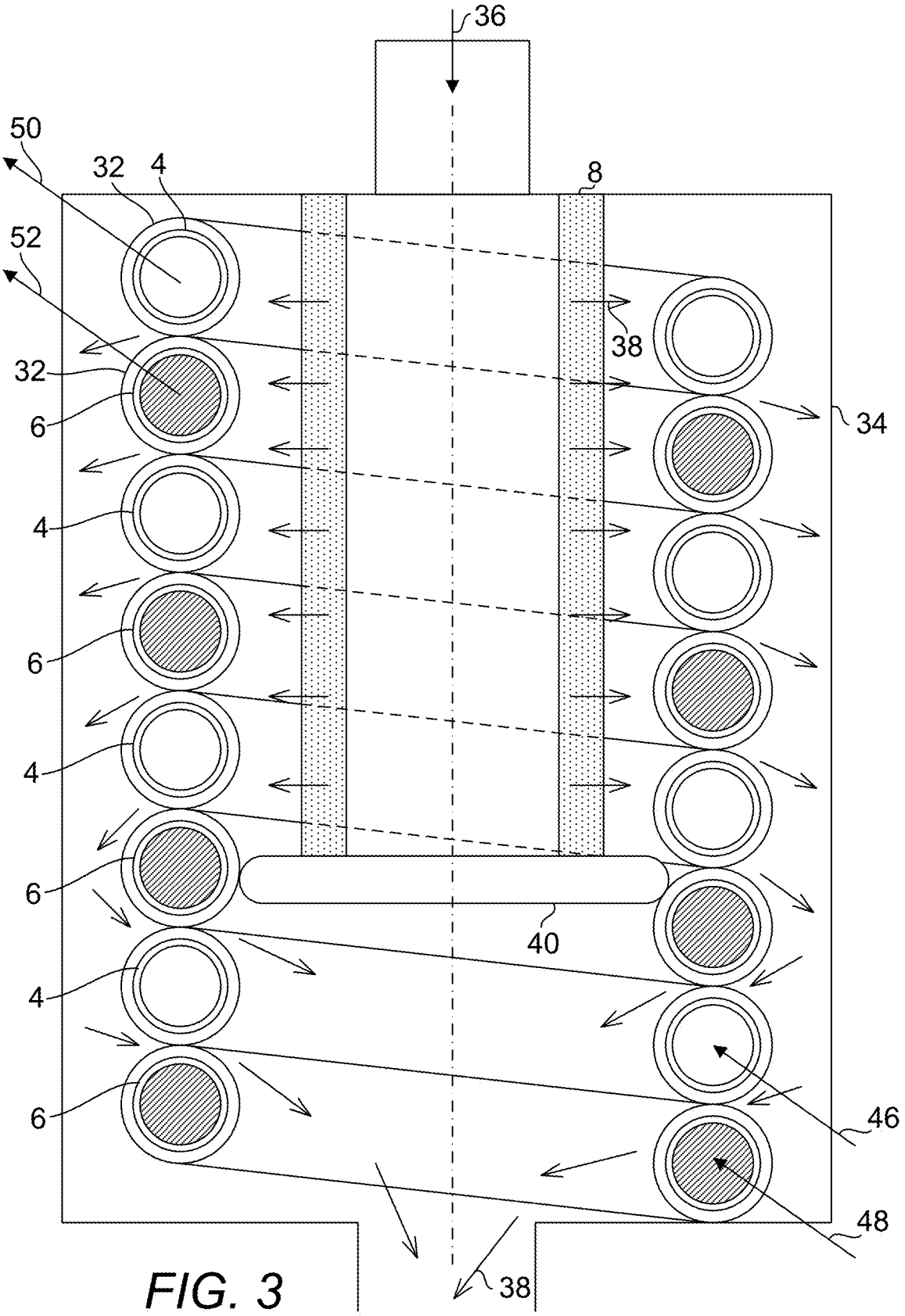
FIG. 3 is a cross-sectional view of a heat exchanger depicting two fluid conductors configured for carrying two flows of one fluid or two separate flows of two different fluids through a heat exchanger.

FIG. 1 is a top front perspective view of a fluid heating system including a heat exchanger system 2. FIG. 2 is a top side view of the fluid conductors 4, 6 of a heat exchanger. FIG. 3 is a cross-sectional view of a heat exchanger depicting two fluid conductors 4, 6 configured for carrying two flows of one fluid or two separate flows of two different fluids through a heat exchanger. Disposed within the heat exchanger system 2 is a heat exchanger that is enclosed in a housing 34. In use and in one embodiment, the heat exchanger receives a forced air/fuel mixture flow 36 from a fan blower 10 connected to the heat exchanger system 2. In the embodiment shown, a flue flow 38 generated as a result of the combustion in the burner 8, flows around the coils 4, 6 as indicated by the arrows and exits via the bottom end of the heat exchanger. In this embodiment, a ceramic plate 40 aids in diverting the flue flow 38 through openings of fins 32 between consecutive loops of coils 4, 6. The detailed description which follows describes flows of a heat exchanger in the context of a tankless hot water system to aid in understanding of the inventive concept in one embodiment of its application. It is to be appreciated, however, that other fluids may be heated, such as, e.g., ethylene glycol in the space heating loop. The heat exchanger includes a top casting and finned helix coils housed in a variable diameter cylindrical stainless steel housing 34. The housing 34 includes a generally cylindrical wall, a lumen, an upper opening and a lower opening. A radial-fired burner is disposed axially and concentrically with the housing 34 inside the lumen of the finned helix coils 4, 6. One or more igniters are disposed in close proximity to the burner 8 for the purpose of igniting an air/fuel mixture 36 received in the burner 8 brought there by blower fan 10.

It shall be noted that the loops of the first fluid conductor 4 are interleaved with the loops of the second fluid conductor 6 and the flows through both conductors 4, 6 receive benefit of heat transfer due to a cylindrical or radial-fired burner 8 disposed within the lumen of both conductors 4, 6. In this embodiment, the diameter of the lumen of the first fluid conductor 4 is substantially the same as the diameter of the lumen of the second fluid conductor 6. In one embodiment, the diameter of the lumen of the first fluid conductor 4 may be different from the diameter of the lumen of the second fluid conductor 6 when heating demands of the two different coils cannot be suitably met. However, multiple coils that are interleaved and substantially the same size as a single coil can be used to replace the single coil its existing housing.

Figure 4:
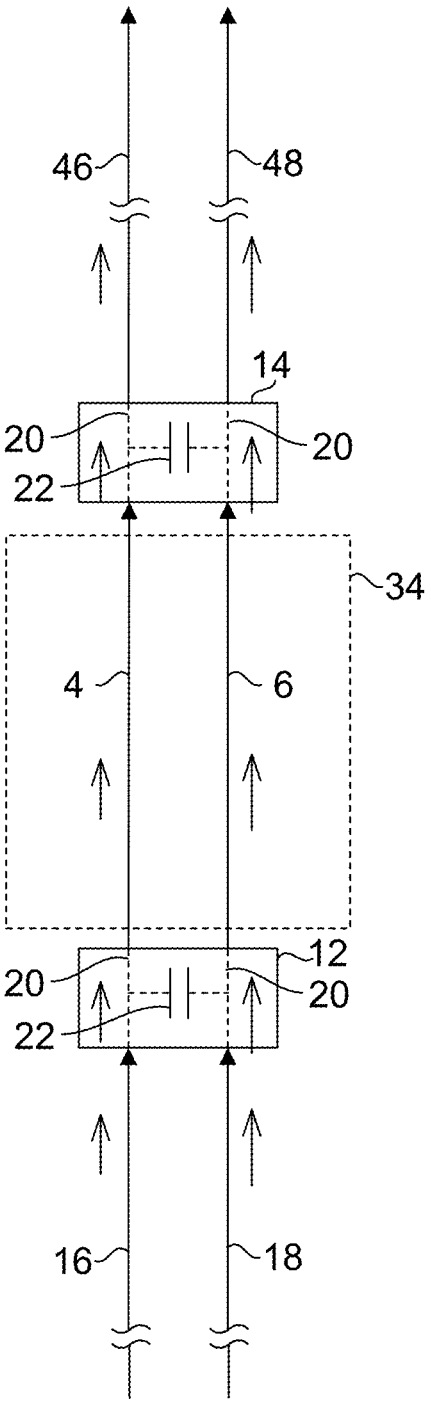
FIG. 4 is a diagram depicting fluid conductors of a heat exchanger configured for carrying two separate fluid flows of two different fluids.
Figure 5:
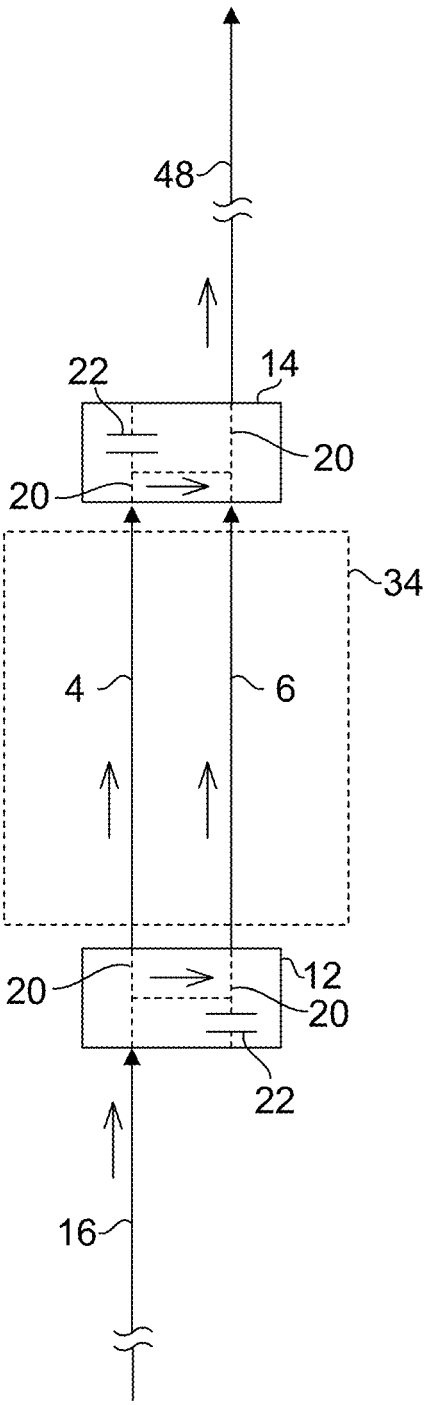
FIG. 5 is a diagram depicting fluid conductors of a heat exchanger configured for carrying a two fluid flows of a single fluid.

FIG. 4 is a diagram depicting fluid conductors 4, 6 of a heat exchanger configured for carrying two separate fluid flows of two different fluids. FIG. 5 is a diagram depicting fluid conductors 4, 6 of a heat exchanger configured for carrying two fluid flows of a single fluid. It shall be noted in FIGS. 4 and 5 that there are two manifolds, i.e., an inlet manifold 12 for receiving flows 16, 18 and channel them each through a flow path 20 in manifold 12 before channeling them through fluid conductors 4, 6 to an outlet manifold 14 which continues to channel the flows each through a flow path 20 in manifold 14 to exit the manifold 14 as flows 46, 48. It shall also be noted that each manifold is configured such that a bridge is made between flow paths 20 in each manifold to potentially allow fluid communication between the two flow paths 20. As shown in FIG. 4, a plug 22 is disposed in this bridge to block any communication between the flow paths 20 to keep the two flows, e.g., domestic water and space heating fluid flows through conductors 4, 6 fluidly separated. In one embodiment, the fluid conductors 4, 6 can both be used to carry one fluid as shown in FIG. 5, e.g., domestic water, e.g., in a system where domestic water is also used in the space heating loop.

The same manifolds of FIG. 4 may be used in a different manner shown in FIG. 5. In FIG. 5, the plug 22 blocking fluid communication between each set of flow paths 20 as shown in FIG. 4 is removed and instead disposed in a manner to block a port to which one of flows 16, 18 is configured to enter manifold 12 or to block a port to which one of flows 46, 48 is configured to exit manifold 14. Before exiting the outlet manifold 14, the two flows, each through one of the conductors 4, 6 merge to form a single flow again. If two separate fluids are used as shown in FIG. 4, the need for using a plate-type heat exchanger to transfer heat from a space heating loop to a domestic water loop or vice versa may be eliminated as direct heat transfer can occur not only between a heat source and a first fluid but also a second fluid. However, if temperature modification is desired, a plate-type or another type of heat exchanger may still be utilized upstream or downstream of the coils 4, 6. It shall be understood that, in one embodiment, flows 16, 18 may be maintained without the manifolds 12, 14 shown in FIG. 4 and may be split and merged without the manifolds 12, 14 shown in FIG. 5. The manifolds 12, 14 ease modifications necessary to switch between one and two-fluid systems.

FIGS. 6-9 depict a water heating system capable of meeting both a demand for domestic hot water and a demand for space heating. The water heating system includes a first flow loop, a second flow loop, a heat source, a first internal bypass line, a second internal bypass line and a heat exchanger thermally coupling the first flow loop and the second flow loop. The first flow loop includes an inlet for receiving flow 18, an outlet for supplying flow 48, a first conductor 4 disposed between the inlet and the outlet of the first flow loop and a first pump 26 disposed between the inlet and the outlet of the first flow loop. The second flow loop includes an inlet for receiving flow 16, an outlet for supplying flow 46, a second conductor 6 disposed between the inlet and the outlet of the second flow loop and a second pump 28 disposed between the inlet and the outlet of the second flow loop. The heat source, e.g., a burner disposed in housing 34 and in a configuration as shown in FIG. 3, is configured for transferring heat to a first flow urged by the first pump 26 within the first flow loop at the first conductor 4 to increase the temperature of the first flow and a second flow urged by the second pump 28 within the second flow loop at the second conductor 6 to increase the temperature of the second flow. The first internal bypass line connects a first portion of the first flow loop and a second portion of the first flow loop and it includes a check valve 30 and is disposed within the water heating system. Another type of valve may be used as long as it restricts the water flow to a single direction. The first internal bypass line provides a path for bypassing the inlet and the outlet of the first flow loop when a demand for domestic hot water does not exist. The check valve 30 prevents a bypass of a flow the inlet to the outlet of the first flow loop. The second internal bypass line 52 includes a three-way valve 50 and the second internal bypass line connects a first portion of the second flow loop and a second portion of the second flow loop and it is disposed within the water heating system. Another type of valve may be used as long as it is capable of directing the space heating flow appropriately. The three-way valve 50 is configured to direct the second flow through the second internal bypass line 42, bypassing the inlet and the outlet of the second flow loop when a demand for space heating does not exist and the second internal bypass line provides a path for the second flow when a demand for space heating does exist. The heat exchanger, e.g., a plate-type heat exchanger 24, thermally couples the first flow loop and the second flow loop. The heat exchanger 24 is configured to cause heat transfer between the first flow of the first flow loop and the second flow of the second flow loop. Heat exchanger 24 allows heat transfer between the domestic water loop through coil 4 and the space heating loop through the second conductor 6. As the setpoint temperature of the first flow may be kept at a lower level than the setpoint temperature of the second flow, the spent returning second flow is disposed at a higher temperature than the just heated first flow, heat transfer occurs from the second flow to the first flow, lowering the heating requirement of the first flow. The first flow loop, second flow loop, heat source and heat exchanger cooperate to produce the first flow at a first temperature at the outlet of the first loop and the second flow at a second temperature at the outlet of the second loop. Pump 26, 28 can either be a fixed-speed or variable-speed pump. A variable-speed pump provides an additional means of adjustment to the controls of the heat exchanger. For instance, if a higher temperature setpoint of the space heating loop is desired, instead of increasing the burner firing rate, the flowrate of the space heating loop can be increased to aid in achieving the setpoint in a timely manner. As both coils 4, 6 are disposed within a heat exchanger and receiving the benefit of a burner concurrently, each of the coils 4, 6 receives substantially the same heat rate. However, as the heat transfer rate is a function of the temperature differential between the temperature of the outer surface and inner surface of each coil, the heat transfer rate to each flow differs due to the difference in temperature of the incoming flows 16, 18. In one embodiment, each coil 4, 6 is configured to receive a total flow of fluid with a flowrate ranging from about 0.5 Gallons Per Minute (GPM) to about 30 GPM and each coil 4, 6 includes a nominal diameter ranging from about 0.5 inch to about 2 inch.

In one embodiment, there is further provided a mixing line 44 including a valve 54. The mixing line 44 connects a third portion of the first flow loop and a fourth portion of the first flow loop. The valve 54 is configured to selectively open to allow an unheated portion of the first flow to be mixed with a heated portion of the first flow to temper the temperature of the first flow at the outlet of the first flow loop.

Figure 6:
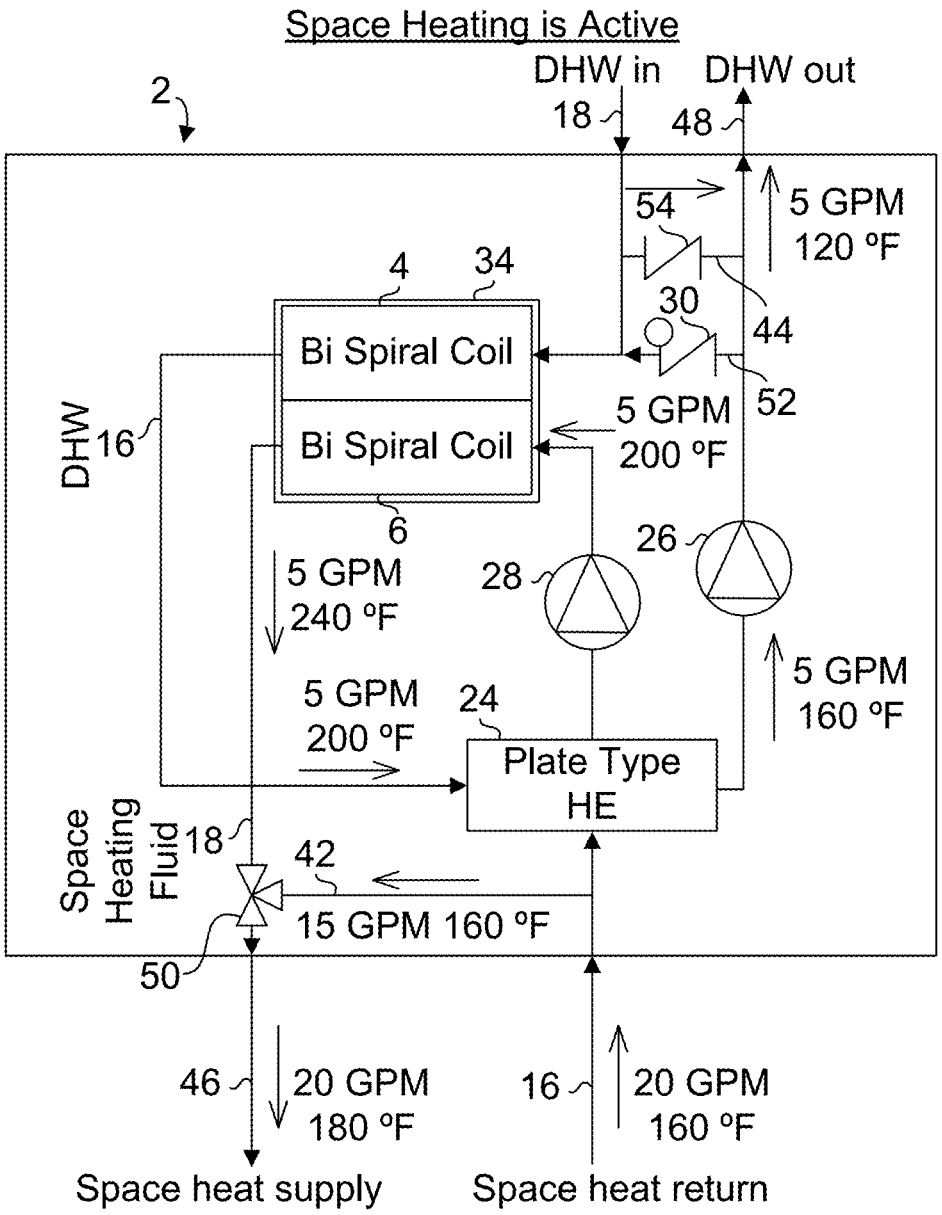
FIG. 6 is a circuit diagram depicting the use of a heat exchanger having more than one fluid conductor where the only demand is a space heating demand.

FIG. 6 is a circuit diagram depicting the use of a heat exchanger having more than one fluid conductor where the only demand is a space heating demand. In this case, no domestic hot water is demanded. However a flow must still be initiated and maintained in the first conductor 4 by pump 26 as it continues to receive heat from a burner disposed in the housing 34. A second fluid conductor 6 is configured to receive a space heating fluid supply that is circulated by pump 28 before supplying it to a plate-type heat exchanger 24 upon receiving heat from the burner in the housing 34. In one example of a 200,000-BTU burner, a space heating demand requires the heat exchanger system to provide a 20 GPM outlet flow 46 at 180 degrees F. The heat exchanger receives a flow 16 of 20 GPM at 160 degrees F. before splitting a portion of the flow amounting to 15 GPM at 160 degrees F. that enters an internal bypass line 42 while the remaining 5 GPM continues to flow through a plate-type heat exchanger 24 and be heated from 160 degrees F. to 200 degrees F. (by the domestic water loop in the plate-type heat exchanger 24) before continuing on to the second conductor 6 to be heated to result in a flow of 5 GPM at 240 degrees F. This heated flow then merges with the flow from the internal bypass line 42 to yield a resultant flow that is about 20 GPM at 180 degrees F. It shall be noted that in this mode, the three-way valve 50 is open in all directions. The resultant flow continues on its path to provide space heating before returning at 160 degrees F.

Figure 7:
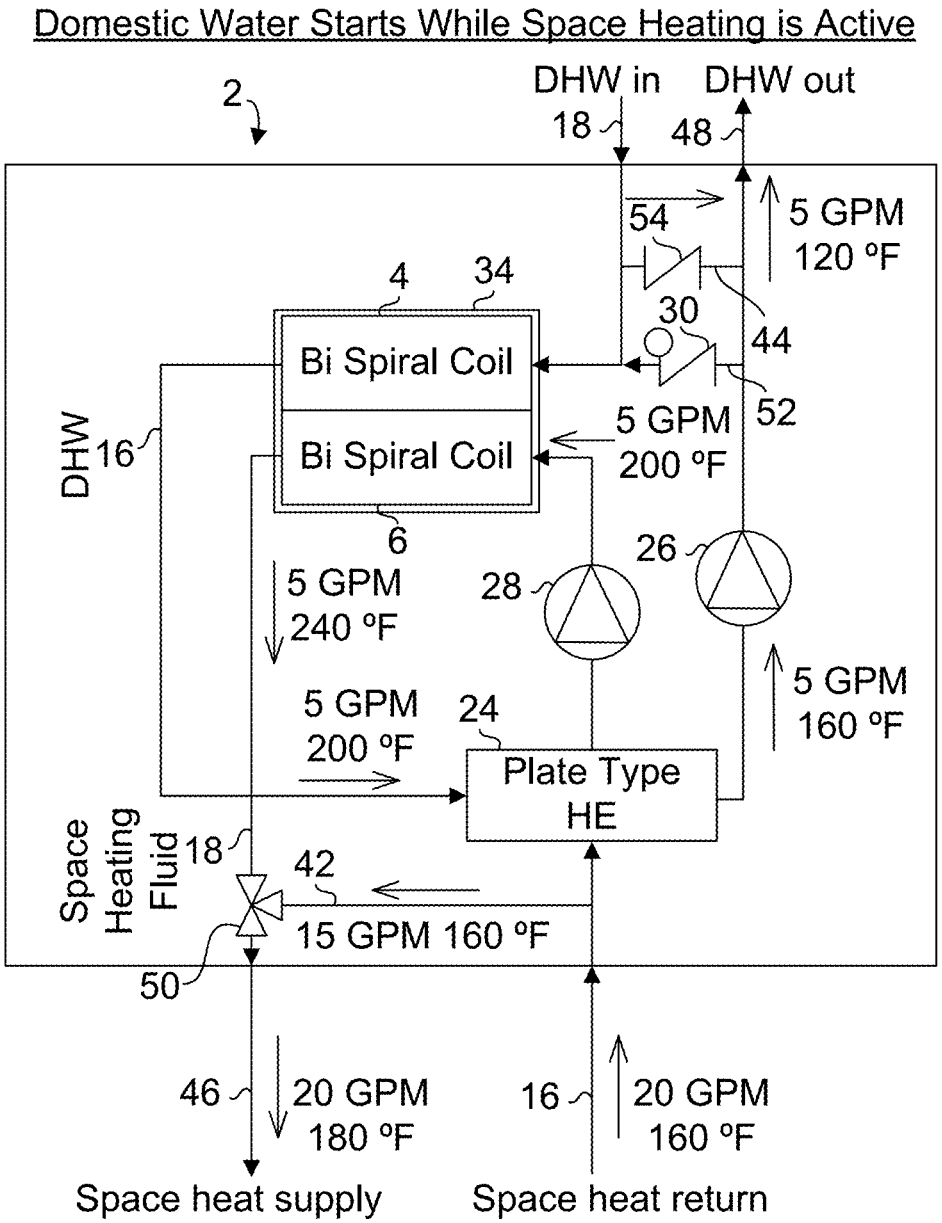
FIG. 7 is a circuit diagram depicting the use of a heat exchanger having more than one fluid conductor where a domestic water demand starts while a space heating demand is being serviced.

FIG. 7 is a circuit diagram depicting the use of a heat exchanger having more than one fluid conductor where a domestic water demand starts while a space heating demand is being serviced. At the start of this demand, e.g., when a flow 48 at the domestic hot water outlet is requested, valve 54 of mixing line 44 is now open to allow a flow of unheated water through mixing line 44 to temper the excessively hot water that is disposed at 160 degrees F. to a temperature that is suitable for human consumption at 120 degrees F.

Figure 8:
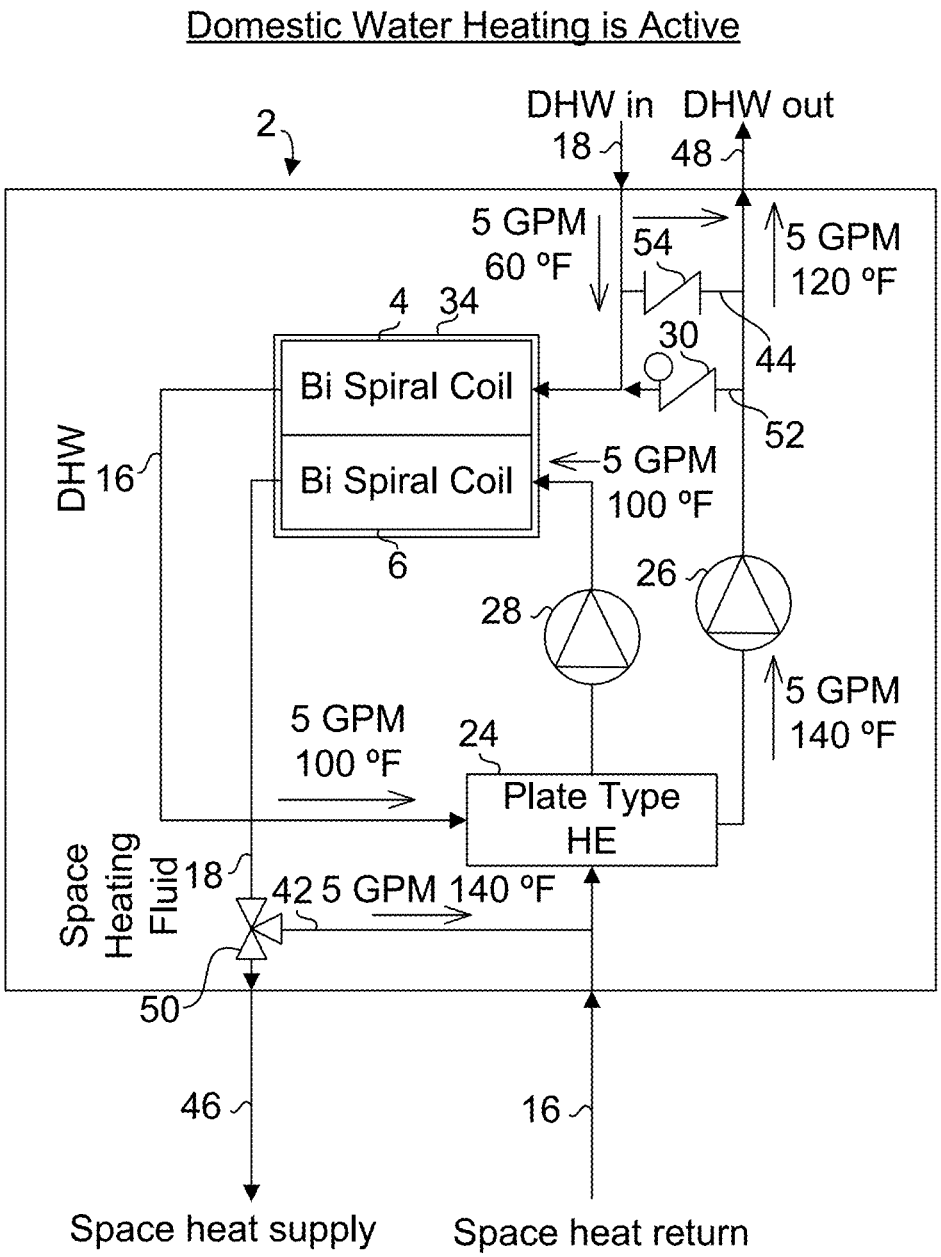
FIG. 8 is a circuit diagram depicting the use of a heat exchanger having more than one fluid conductor where the only demand is a domestic hot water demand.

FIG. 8 is a circuit diagram depicting the use of a heat exchanger having more than one fluid conductor where the only demand is a domestic hot water demand. When a domestic water demand exists, the flow 48 through the first fluid conductor 4 proceeds to exit the domestic hot water outlet. A check valve 30 interposed between the domestic water inlet and domestic water outlet prevents a cold inlet flow 18 from exiting directly through the domestic water outlet but allows recirculation through the first fluid conductor 4 if necessary. Pump 26 causes recirculation via check valve 30 if a domestic water demand has ceased. Alternatively, pump 26 may be left off if no recirculation is desired while space heating demand is also non-existent. In one example of a 200,000 BTU burner, a domestic hot water demand of 5 GPM causes a water supply to enter the domestic hot water loop to enter the heat exchanger at 60 degrees F. before being heated in the first conductor 4 to about 100 degrees F. Heat transfer occurs from the space heating loop to the domestic hot water loop in the plate type heat exchanger 24 to result in a domestic hot water flow disposed at 140 degrees F. that is tempered by unheated water at the mixing line 44 before exiting the domestic hot water loop via domestic hot water outlet at 120 degrees F.

Figure 9:
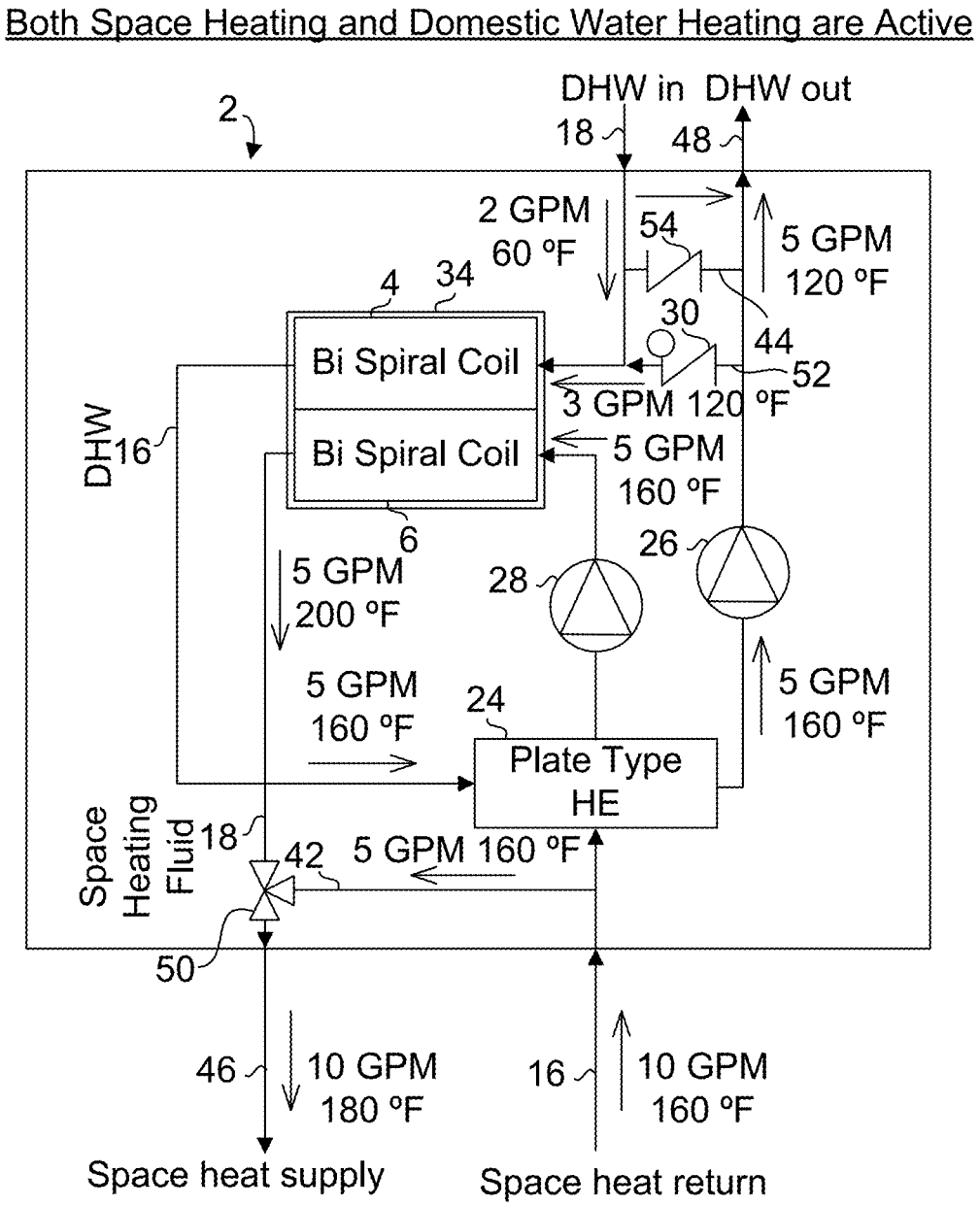
FIG. 9 is a circuit diagram depicting the use of a heat exchanger having more than one fluid conductor where both a domestic hot water demand and a space heating demand exist.

FIG. 9 is a circuit diagram depicting the use of a heat exchanger having more than one fluid conductor where both a domestic hot water demand and a space heating demand exist. In one example, a 5 GPM of domestic hot water demand exists while a space heating demand requires only 10 GPM disposed at 180 degrees F. An incoming flow 18 of 2 GPM at 60 degrees F. enters the heat exchanger before merging with an internal flow of 3 GPM at 120 degrees F. to result in a flow of 5 GPM which enters fluid conductor 4 to be heated to 160 degrees F. For the space heating loop, a flow of 5 GPM splits off into internal bypass line 42 and the remaining flow of another 5 GPM continues into conductor 6 at 160 degrees F. before being heated to 200 degrees F. It shall be noted that as each of the flows entering heat exchanger 24 is disposed at 160 degrees F., i.e., a temperature that is the same as the domestic water flow, no heat transfer occurs between the two flows coupled in heat exchanger 24. Upon exiting conductor 6, the flow of the space heating loop merges with the flow through the internal bypass line 42 to form a total flow of 10 GPM at 180 degrees F. It shall be noted that with the present heat exchanger, both a domestic hot water demand and a space heating demand can be met concurrently.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A fluid heating system for meeting both a first demand and a second demand, said fluid heating system comprising:

(a) a first flow loop comprising an inlet, an outlet, a first conductor disposed between said inlet and said outlet of said first flow loop and a first pump disposed between said inlet and said outlet of said first flow loop;

(b) a second flow loop comprising an inlet, an outlet, a second conductor disposed between said inlet and said outlet of said second flow loop and a second pump disposed between said inlet and said outlet of said second flow loop;

(c) a heat source configured for transferring heat to a first flow urged by said first pump within said first flow loop at said first conductor to increase a temperature of the first flow and a second flow urged by said second pump within said second flow loop at said second conductor to increase a temperature of the second flow;

(d) a first internal bypass line comprising a first valve, said first internal bypass line connecting a first portion of said first flow loop and a second portion of said first flow loop, wherein said first internal bypass line provides a path for bypassing said inlet and said outlet of said first flow loop when the first demand does not exist and said first valve prevents a bypass of a flow from said inlet to said outlet of said first flow loop;

(e) a second internal bypass line comprising a second valve, said second internal bypass line connecting a first portion of said second flow loop and a second portion of said second flow loop and said second valve is disposed at said second portion of said second flow loop, said second valve configured to direct the second flow through said second internal bypass line, bypassing said inlet and said outlet of said second flow loop when the second demand does not exist and said second internal bypass line provides a path for the second flow when the second demand does exist; and (f) a heat exchanger thermally coupling said first flow loop and said second flow loop, said heat exchanger is configured to cause heat transfer between the first flow of said first flow loop and the second flow of said second flow loop;

wherein said first flow loop, said second flow loop, said heat source and said heat exchanger cooperate to produce the first flow at a first temperature at said outlet of said first flow loop and the second flow at a second temperature at said outlet of said second flow loop; wherein at least one of said first and second conductor is a coil.

2. The fluid heating system of claim 1, wherein each of said first and second conductor is a coil and said first and second conductor are configured to be interleaved to form a structure of a single-sized lumen in which said heat source is disposed.

3. The fluid heating system of claim 1, wherein said heat source is a radial-fired burner.

4. The fluid heating system of claim 1, further comprising a mixing line comprising a valve, said mixing line connecting a third portion of said first flow loop and a fourth portion of said first flow loop, said valve of said mixing line is configured to selectively open to allow an unheated portion of the first flow to be mixed with a heated portion of the first flow to temper the temperature of the first flow at said outlet of said first flow loop.

5. The fluid heating system of claim 1, wherein said heat exchanger is a plate-type heat exchanger.

6. The fluid heating system of claim 1, wherein said first valve is a check valve.

7. The fluid heating system of claim 1, wherein said second valve is a three-way valve.

8. The fluid heating system of claim 1, wherein the first demand is a domestic hot water demand.

9. The fluid heating system of claim 1, wherein the second demand is a space heating demand.

* * * * *